United States Patent [19]

Kudlicka et al.

[11] Patent Number: 4,611,534

[45] Date of Patent: Sep. 16, 1986

[54] BALE STRAPPING APPARATUS

[75] Inventors: Mark L. Kudlicka, Lake Oswego; Albert E. Cranston, III, Wilsonville, both of Oreg.

[73] Assignee: Cranston Machinery Co., Inc., Oak Grove, Oreg.

[21] Appl. No.: 720,691

[22] Filed: Apr. 8, 1985

[51] Int. Cl.[4] ..... B65B 13/04

[52] U.S. Cl. ..... 100/26; 53/589

[58] Field of Search ..... 100/3, 8, 25, 26; 53/589, 590, 592

[56] References Cited

U.S. PATENT DOCUMENTS

| | | | |
|---|---|---|---|
| 2,409,652 | 10/1946 | Workman | 100/26 |
| 2,838,992 | 6/1968 | Demler | 100/8 X |
| 3,009,984 | 11/1961 | Lindgren | 49/372 X |
| 3,387,556 | 6/1968 | Cranston | 100/26 X |
| 3,521,550 | 7/1970 | Van Doorn | 100/26 |
| 3,720,158 | 3/1973 | Sauer | 100/26 X |
| 3,733,769 | 5/1973 | Van Doorn | 100/26 X |
| 4,111,114 | 9/1978 | Carr | 100/913 X |
| 4,403,542 | 9/1983 | Lewis | 100/26 |

*Primary Examiner*—Billy J. Wilhite

*Attorney, Agent, or Firm*—Lee R. Schermerhorn

[57] ABSTRACT

In the illustrated embodiments, with a bale of material compressed between upper and lower press platens an end binder moves toward one end of the bale and a back track moves toward the opposite end to apply a loop of strap around the top, bottom and ends of the bale. Two side binders move from station to station along opposite sides of the bale to apply loops of strap around the top, bottom and sides of the bale at two strap positions at each station. Each side binder has a strapping section movable toward and away from the adjacent side of the bale. Strap guide tracks on the press platens are provided with covers which confine the straps during their feed movements and prevent premature release from the tracks.

11 Claims, 16 Drawing Figures

BALE STRAPPING APPARATUS

BACKGROUND OF THE INVENTION

This invention relates to an apparatus for strapping bales of resilient material such as synthetic fibers, cotton or wool.

This apparatus contains certain improvements over the apparatus disclosed in U.S. Pat. No. 4,403,542 which is assigned to the assignee of the present application.

The improvements embodied in the present apparatus are directed to the problems of wire control when high tensile strength wire in the range of 120,000 to 190,000 PSI is used to bind the bales of material. This wire has a large diameter in the range of 0.072 to 0.162 inch or even larger. The present apparatus provides better retention of the wire in the wire tracks during the feed cycle and better control during the tension cycle. The wire must stay in the tracks until it is desired to be removed.

The heavier wire is necessary to provide strength in wire strapping or binding applications where the package is extremely heavy or large, and also in those applications where the package is wire strapped or bound in a press during its pressed dimension.

For example in binding synthetic fiber bales the bale is wire strapped at a pressed dimension of approximately 29½ inches in height. After the strapping is around the bale the press is released and the bale expands into the wire strapping. This produces re-growth pressure against the resistance of the wire strapping. The bale can be prewrapped or not wrapped.

This heavy high tensile wire is very stiff and springy. It produces much more resistance and pressure on both straight and curved wire tracks than does the lighter tensile or small diameter wire commonly used for other applications.

SUMMARY OF THE INVENTION

In the illustrated embodiments of the present apparatus a bale of material is compressed between upper and lower press platens. An end binder moves toward one end of the bale and a back track moves toward the opposite end to apply a loop of strap around the top, bottom and ends of the bale. Two side binders move from station to station along opposite sides of the bale to apply loops of strap around the top, bottom and sides of the bale, at two strap positions at each station.

Each side binder has a carriage section supporting a strapping section which is movable toward and away from the adjacent side of the bale. Strap guide tracks on the press platens are provided with covers which confine the straps during their feed movements and prevent premature release from the tracks.

An automatic sequence of operations is started by a signal from the press that the press chamber is ready for strapping of the compressed bale of material. The end binder and end back track move into place adjacent opposite ends of the compressed bale. At the same time, the two side binders move to a first strapping station for applying the first two wires, and their strapping sections move inward to wire feed positions adjacent the opposite sides of the bale.

Then the end binder feeds wire around longitudinal platen tracks and back into the end binder which grips and then immediately tensions the longitudinal wire around the bale. The two side binders feed wires, overlying the longitudinal wire, around other platen guide tracks, grip the wires, tension the wires and tie the knots in the wires.

Then the strapping sections of the two side binders retract, the side binders move to the second binding station and the operations just described for the first binding station are repeated, the side binders moving from station to station until all the transverse wires are applied, tensioned and knotted.

Then the two side binders return to their original home positions and stop and the end binder simultaneously retensions and ties a knot in the longitudinal wire, releases the wire and the end binder and end back track retract to their rest positions, giving a signal to the press to open and discharge the bound bale.

Various safety devices are provided for situations where a binding cycle is not properly completed.

The invention will be better understood and additional features and advantages will become apparent from the following description of the preferred embodiments illustrated in the accompanying drawings. Various changes may be made in the details of construction and arrangement of parts and certain features may be used without others. All such modifications within the scope of the appended claims are included in the invention.

DESCRIPTION OF THE PREFERRED EMBODIMENTS

Figure 3:
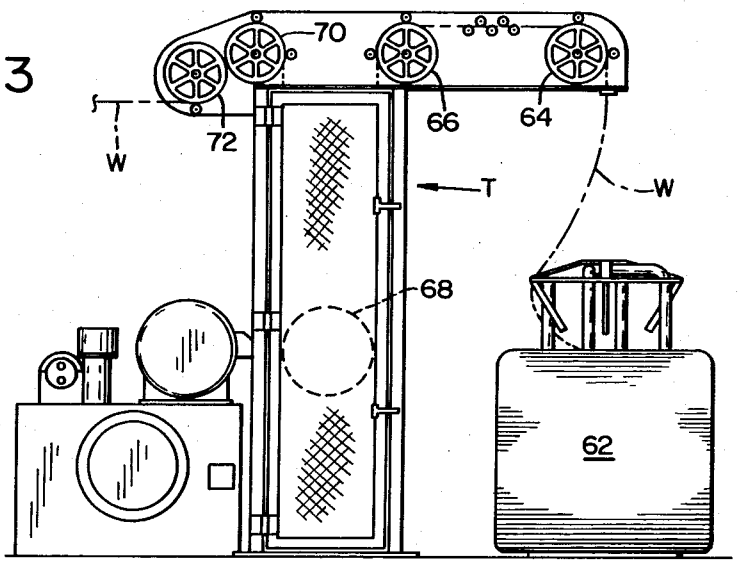
FIG. 3 is a side elevation view of a suitable take-up stand assembly.

By way of example the present apparatus is illustrated and described in the drawings and specification as applied to a conventional synthetic fiber press. The strapping material is preferably round steel wire and the system is fully automatic.

The strapping cycle is automatically started when the press follower reaches the preset bale compression setting, and after the strapping is completed the system signals the press to eject the bale and continue its function of preparing another bale for strapping. No operator intervention or attention is required. Manual function pushbutton controls are also provided for use when needed.

Figure 1:
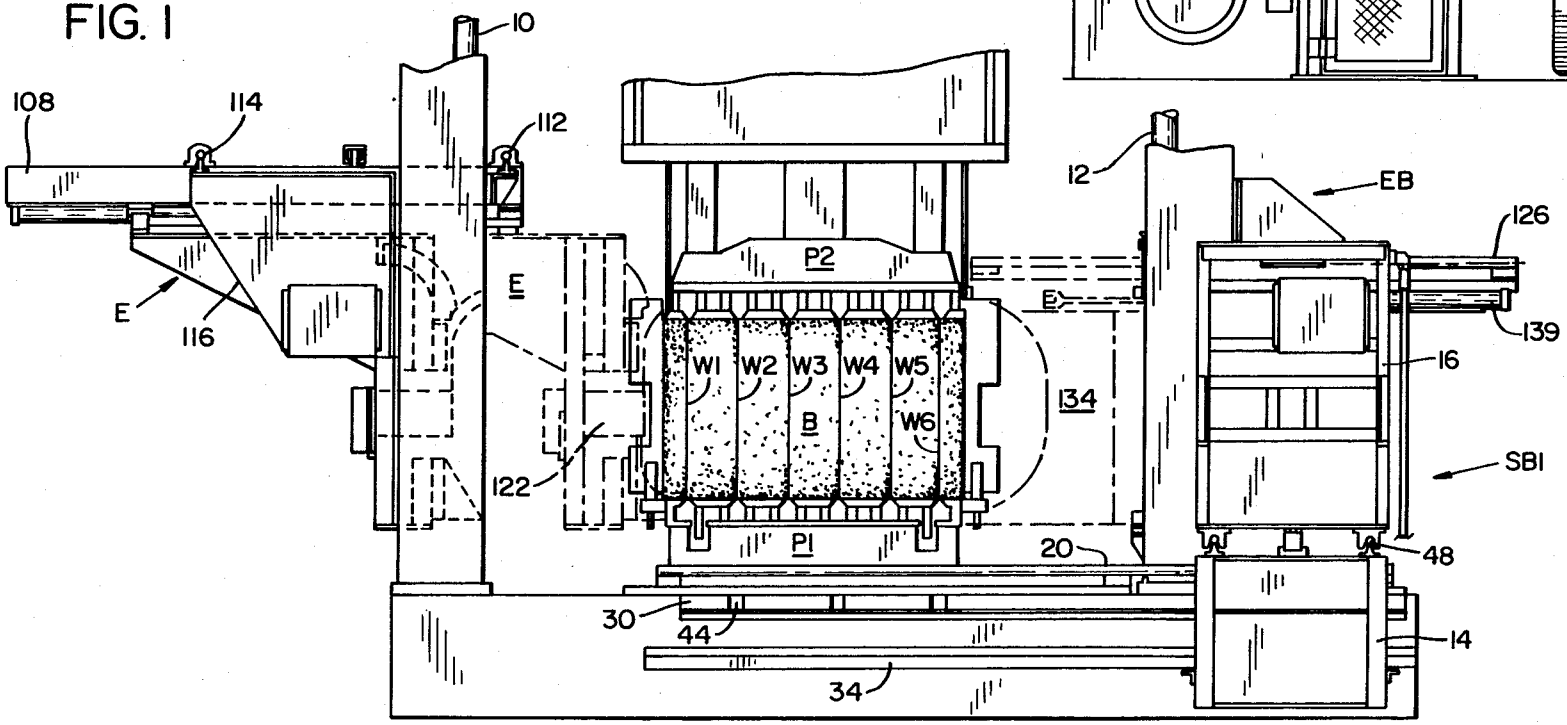
FIG. 1 is a front elevation view of the bale strapping apparatus with parts in section.
Figure 2:
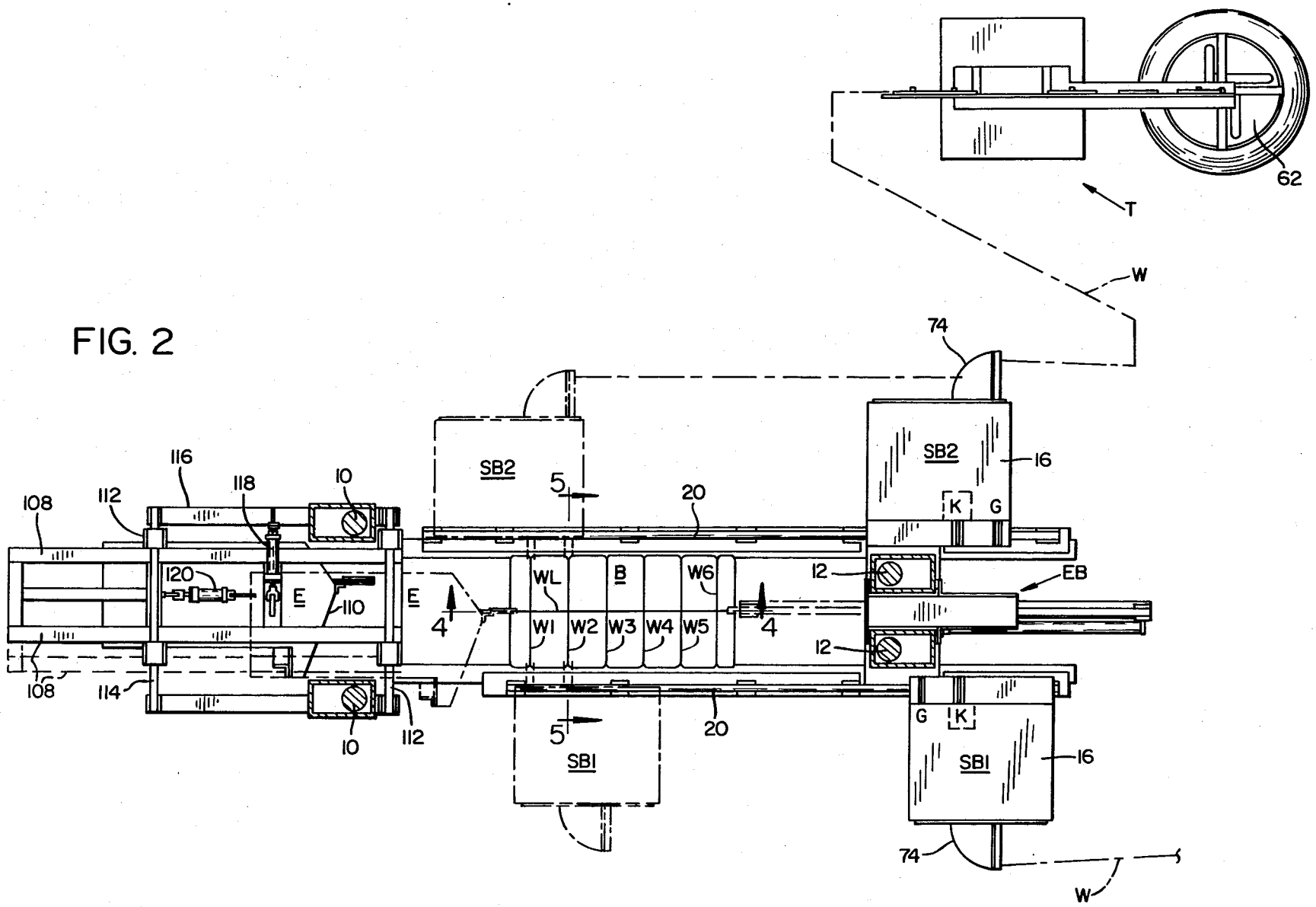
FIG. 2 is a top plan view of the bale strapping apparatus under the top press platen, with parts in section.

In FIGS. 1 and 2 a bale B is compressed for strapping between a lower press platen P1 and an upper press platen P2. The upper platen and the upper part of the press structure have been removed in the plan view in FIG. 2, this upper structure being supported by two columns 10 at the left end and two columns 12 at the right end of the press. Other presses are made differently and the present apparatus is adapted to the form of press construction.

At the left end of the press is an end binder E and at the right end is an end back track assembly EB. On the front side of the press is a side binder SB1 and on the back side is a substantially identical side binder SB2. As seen in FIG. 2 the back side binder SB2 is supplied with wire strapping W from a take-up stand assembly T. The other binder SB1 and end binder E are supplied with identical or similar take-up stand assemblies, not shown.

When the press signals that it has compressed the bale B to a predetermined dimension the strapping operation begins. End binder E moves from a rest position shown in solid lines in FIG. 2 to an operating position close to the end of the bale shown in broken lines and end back track assembly EB moves from a rest position away from the bale to an operating position close to the opposite end of the bale.

At the same time, front side binder SB1 moves from its rest position in solid lines in FIG. 2 to its first operating station shown in broken lines and back side binder SB 2 moves from its rest position in solid lines to its first operating station shown in broken lines. This direction of movement may have to be reversed for some press configurations.

A longitudinal strap loop WL is applied first by end binder E and end back track assembly EB. Front side binder SB1 is equipped with strap feed, tensioning and knotter mechanisms to apply a transverse wire loop W2 while back side binder SB2 applies a transverse wire loop W1. Side binder SB1 has a back track to guide the wire loop W1 from back side binder SB2 and back side binder SB2 has a guide track to guide the wire loop W2 from front side binder SB1 whereby the first two bindings W1 and W2 are applied simultaneously.

Then the front and back side binders SB1 and SB2 move to a second binding station to simultaneously apply the bindings W3 and W4 and thence to a third binding station to apply the bindings W5 and W6, all overlying the longitudinal binding WL.

Then the end back track assembly EB retracts and the three binders E, SB1 and SB2 retract to their rest positions shown in solid lines in FIG. 2 and the strapped bale is ejected from the press.

Figure 11:
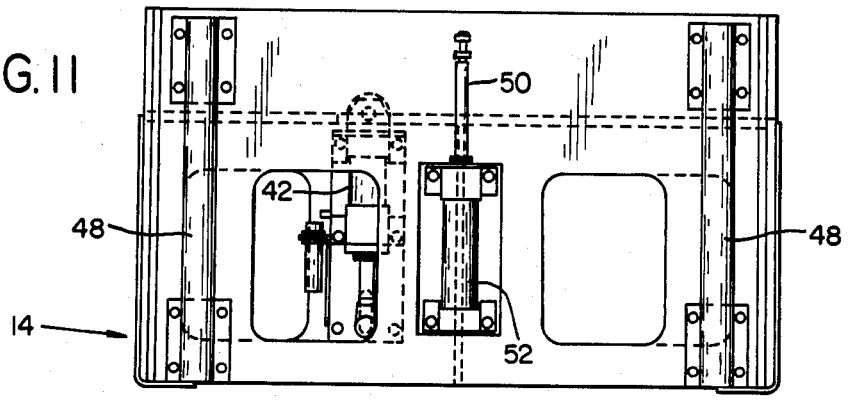
FIG. 11 is a sectional view on the line 11—11 in FIG. 9.
Figure 9:
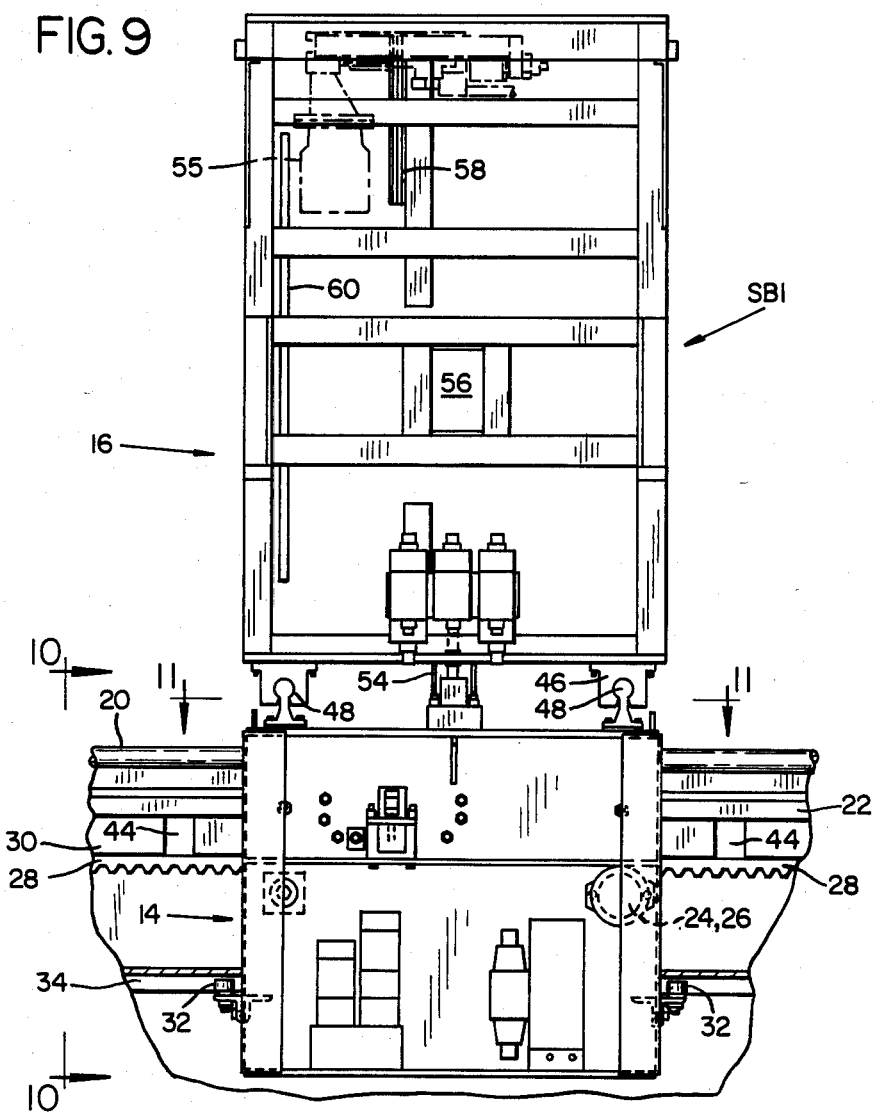
FIG. 9 is a front elevation view of a side binder showing its carriage section and strapping section.
Figure 10:
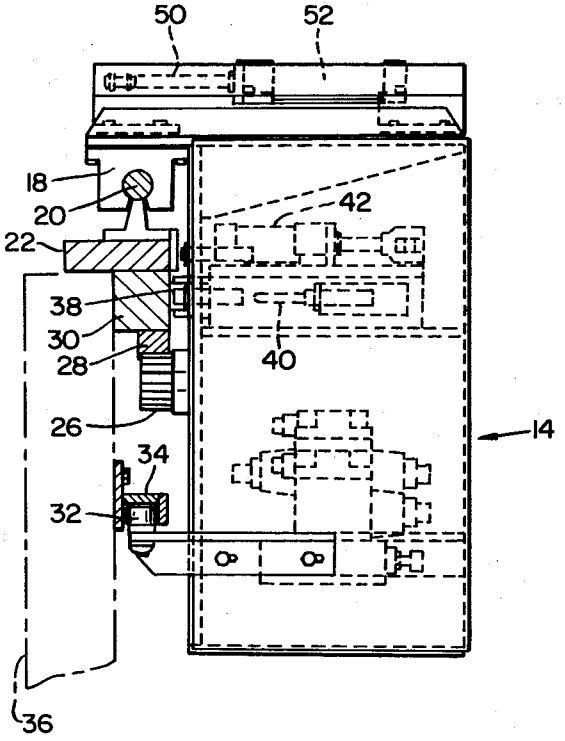
FIG. 10 is a sectional view on the line 10—10 in FIG. 9, showing a side binder carriage section.

As best seen in FIGS. 9, 10 and 11, the side binder SB1 comprises a carriage section 14 and a strapping section 16. As best seen in FIG. 10, carriage section 14 is supported by a pair of open pillow blocks 18 which slide on a horizontal cylindrical rail 20 mounted on a support rail 22 in front of the lower press platen P1. Carriage section 14 has a rack and pinion type drive mechanism comprising a hydraulic motor 24 and drive gear 26 in the carriage, the drive gear engaging a travel rack 28 on the underside of a latch bar 30 which is also mounted on support rail 22. Motor 24 may be air or electrically operated.

The lower part of carriage section 14 is stabilized by a pair of cam rollers 32 which travel in a guide track 34 mounted on a frame member 36 which also supports the support rail 22.

Carriage section 14 is accurately positioned at each strapping station by a stop roller 38 on a stop plunger 40 actuated by a hydraulic cylinder 42, similar to the stop mechanism in said U.S. Pat. No. 4,403,542. Stop roller 38 enters holes 44 in latch bar 30 in FIG. 1.

In side binder SB1, strapping section 16 is mounted on top of carriage section 14 for movement toward and away from the side of the bale B as shown in FIGS. 9 and 11. A pair of open pillow blocks 46 on the bottom of strapping section 16 are mounted for sliding movement on a pair of cylindrical rails 48 on top of carriage section 14, the rails 48 being at right angles to the rail 20 in FIG. 10.

A piston rod 50 in hydraulic cylinder 52 on the top side of carriage section 14 and parallel with the rails 48 is connected to a bracket 54 on the underside of strapping section 16 to move the strapping section on rails 48. A wire feed and tensioning mechanism 55 and knotter mechanism 56 are associated with a curved vertical wire track 58 (FIG. 9) on the side of strapping section 16 facing the bale B. These mechanisms may be conventional and are not described in detail. Also on this side of the strapping section is a vertical back track wire guide 60 to be described in detail. The back side binder SB2 is substantially identical to the front side binder SB1 described above. 10 Each of these side binders is supplied with strapping wire from a take-up stand assembly T as shown in FIGS. 2 and 3. When the wire feed mechanism in one of the side binders is operating, wire is pulled upward from the wire coil supply source 62 over sheaves 64 and 66 then downward and around the underside of take-up sheave 68 and around discharge sheaves 70 and 72 in FIG. 3 to the wire inlet guide 74 in FIG. 2. This pulls take-up sheave 68 to the top of its vertical stand frame.

When the wire loop thus applied to the bale B is tensioned around the bale by the side binder, the direction of the wire movement is reversed around sheaves 70 and 72 as the resulting slack in the wire is taken up by the downward movement of take-up sheave 68.

Figure 5:
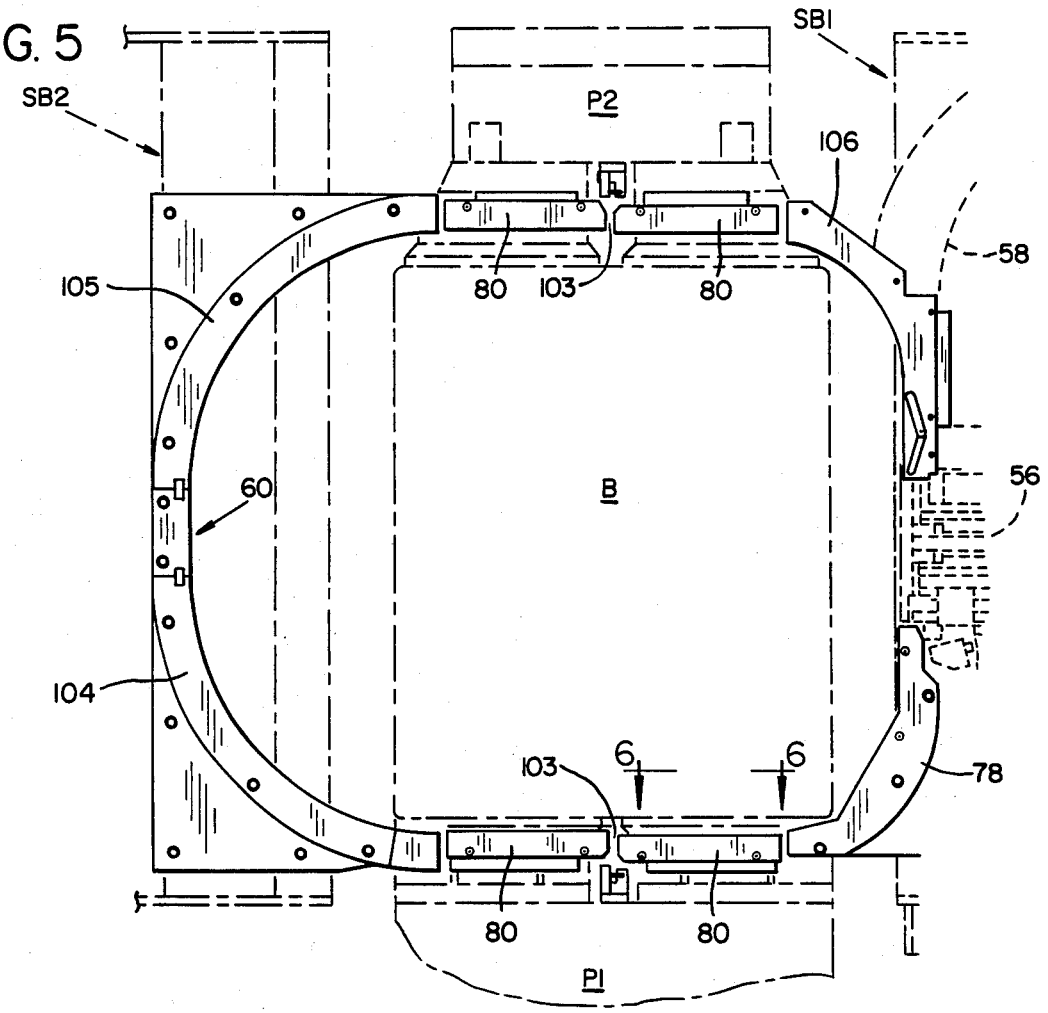
FIG. 5 is a sectional view on the line 5—5 in FIG. 2.

The wire passes through inlet guide 74 in FIG. 2 to the wire feed and tensioning mechanisms 55 and then into the curved vertical wire trck 58 to the knotter 56 in FIG. 5. From these mechanisms the wire passes through a curved guide track 78 around a lower corner of the bale B to a straight horizontal guide track 80 in the lower press platen P1.

A sectional view at wire W1 in FIG. 2 would show knotter 56 on the left in binder SB2 and guide tracks 104 and 105 on the right in binder SB1, simply reversing FIG. 5 as previously explained. The knotters in both binders operate simultaneously to secure the wires W1 and W2. In the broken line positions of the binders at the first strapping station in FIG. 2 knotter K in SB1 is opposite guide track G in SB2 and guide track G in SB1 is opposite knotter K in SB2.

Figure 6:
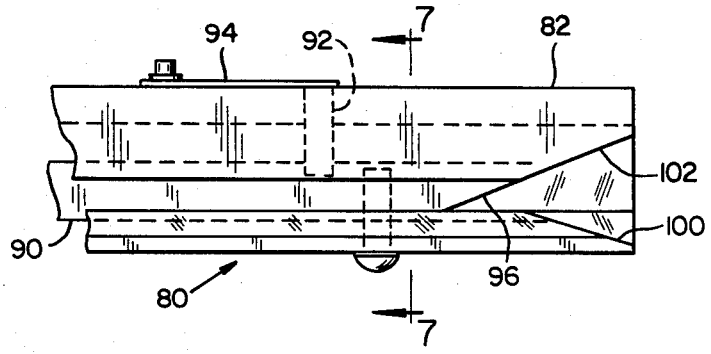
FIG. 6 is a view on the line 6—6 in FIG. 5.
Figure 7:
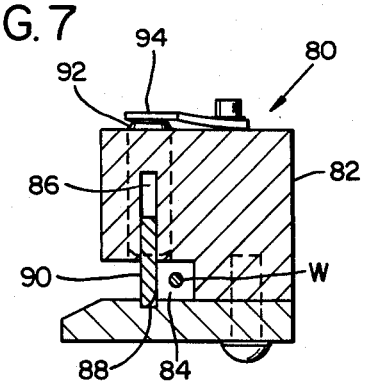
FIG. 7 is a sectional view on the line 7—7 in FIG. 6 showing the strap track cover in its normally closed position.
Figure 8:
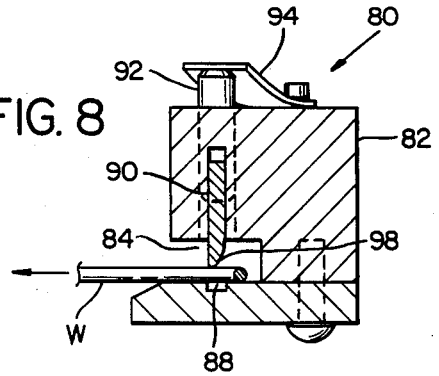
FIG. 8 is a sectional view corresponding to FIG. 7 but showing the strap track cover in open position.

The details of construction of guide track 80 are shown in FIGS. 6, 7 and 8. A track member 82 has a slot 84 facing the bale to receive the wire W. The opposite side walls of slot 84 are provided with aligned slots 86 and 88 to receive a flat cover strip 90. Slot 88 is of shallow depth to receive one edge portion of cover strip 90 while the opposite slot 86 is of sufficient depth to receive and contain the whole width of cover strip 90. Cover strip 90 is normally pressed into slot 88 by a pin 92 pressed inward by a leaf spring 94 against a slotted edge of cover strip 90 to close the wire slot 84 and confine the wire W in the bottom of this slot as shown in FIG. 7. Thus, as the end of the wire is pushed through slot 84 by the wire feed mechanism 55 in FIG. 9, the wire is confined in slot 84 during its forward travel through the slot.

When the direction of travel of the wire through slot 84 is reversed to tension the wire around the bale B by the wire tensioning mechanism 55, the wire is pulled upward out of the curved guide track 78 and engages the beveled end 96 on cover strip 90 in FIG. 6, to push the cover strip back into the slot 86 against the force of spring 94 on pin 92 and open the slot 84 so that the wire can leave this slot and be tightened against the underside of the bale. To facilitate this release action, the edge of cover strip 90 which is engaged by the wire, is beveled at 98 as shown in FIG. 8 and the end of guide track member 82 adjacent the curved guide track 78 is also beveled at 100 and 102 as shown in FIG. 6.

In order to allow for the application of longitudinal wire WL the guide track 80 in FIG. 5 extends only halfway across the width of the underside of the bale resting on lower platen P1. The wire is guided under the remaining half of the width of the bale by a second guide track 80 as indicated in FIG. 5, leaving a space 103 for wire WL. Similarly, at the top of the bale there is a guide track 80 as described above extending across half the width of the bale and a second straight guide track 80 extending across the remaining half of the bale, leaving a space 103 for wire WL therebetween. In the guide tracks 80 in the upper platen P2 the tapered end 96 of cover strip 90 is on the left end in FIG. 5.

Arcuate back track guide tracks 104 and 105 guide the wire around the lower and upper corners on the backside of the bale and an arcuate guide track 106 guides the advancing end of the wire around the upper corner on the front side of the bale to the gripper and knotter mechanisms at 56. These arcuate guide tracks 78, 104, 105 and 106 are preferably of the type shown in said U.S. Pat. No. 4,403,542.

As seen in FIGS. 1 and 2 end binder E has a carriage section 108 and a strapping section 110. Carriage section 108 is supported by bearings 112 for side travel on a pair of rods 114 mounted at their ends in a stationary support frame 116. This side travel of carriage section 108, indicated by broken lines in FIG. 2, is produced by a hydraulic or air cylinder and piston rod 118 connected between carriage section 108 and support frame 116.

Strapping section 110 is moved toward and away from the end of bale B by a hydraulic or air cylinder and piston rod 120 connected between carriage section 108 and strapping section 110. This movement of strapping section 110 to a position close to one end of the bale is indicated by broken lines in FIG. 2. Strapping section 110 is equipped with wire feed and tensioning mechanism (not shown) and knotter mechanism 122 for the wire WL.

Figure 12:
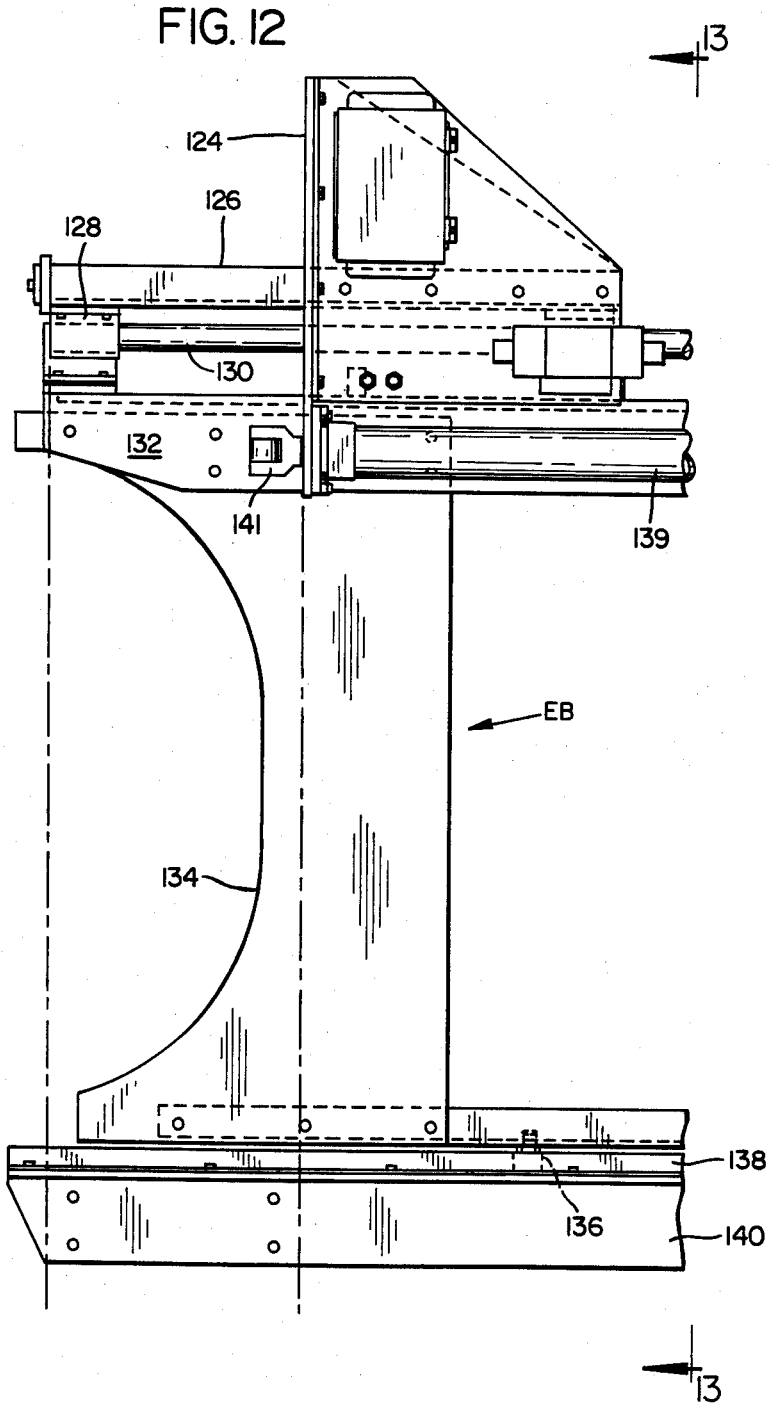
FIG. 12 is a front elevation view of the end back track mount assembly.
Figure 13:
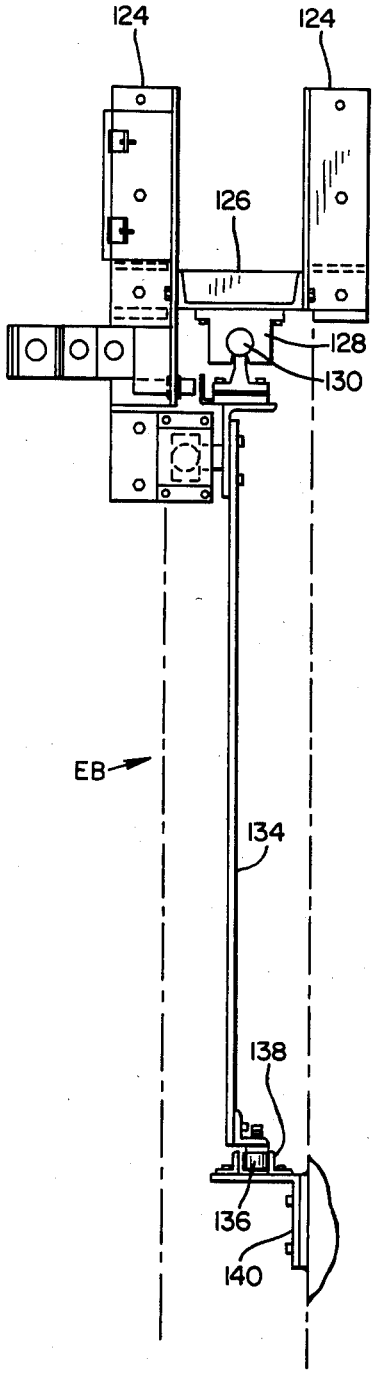
FIG. 13 is a view on the line 13—13 in FIG. 12.

The structure of end back track assembly EB is shown in FIGS. 12 and 13. The support member 124 has a horizontal part 126 with an open pillow block 128 at each end. A cylindrical shaft 130 slides in these pillow blocks, this shaft carrying a supporting bar 132 for a vertical back track mounting plate 134. The lower end of mounting plate 134 is guided in its movements toward and away from the end of the bale by two cam rollers 136 in a channel track 138 on a stationary bottom support plate 140. These movements are produced by a hydraulic cylinder 139 connected to support member 124 and a piston rod connected at 141 to supporting bar 132. The back track assembly may be mounted differently on different types of presses.

Figure 4:
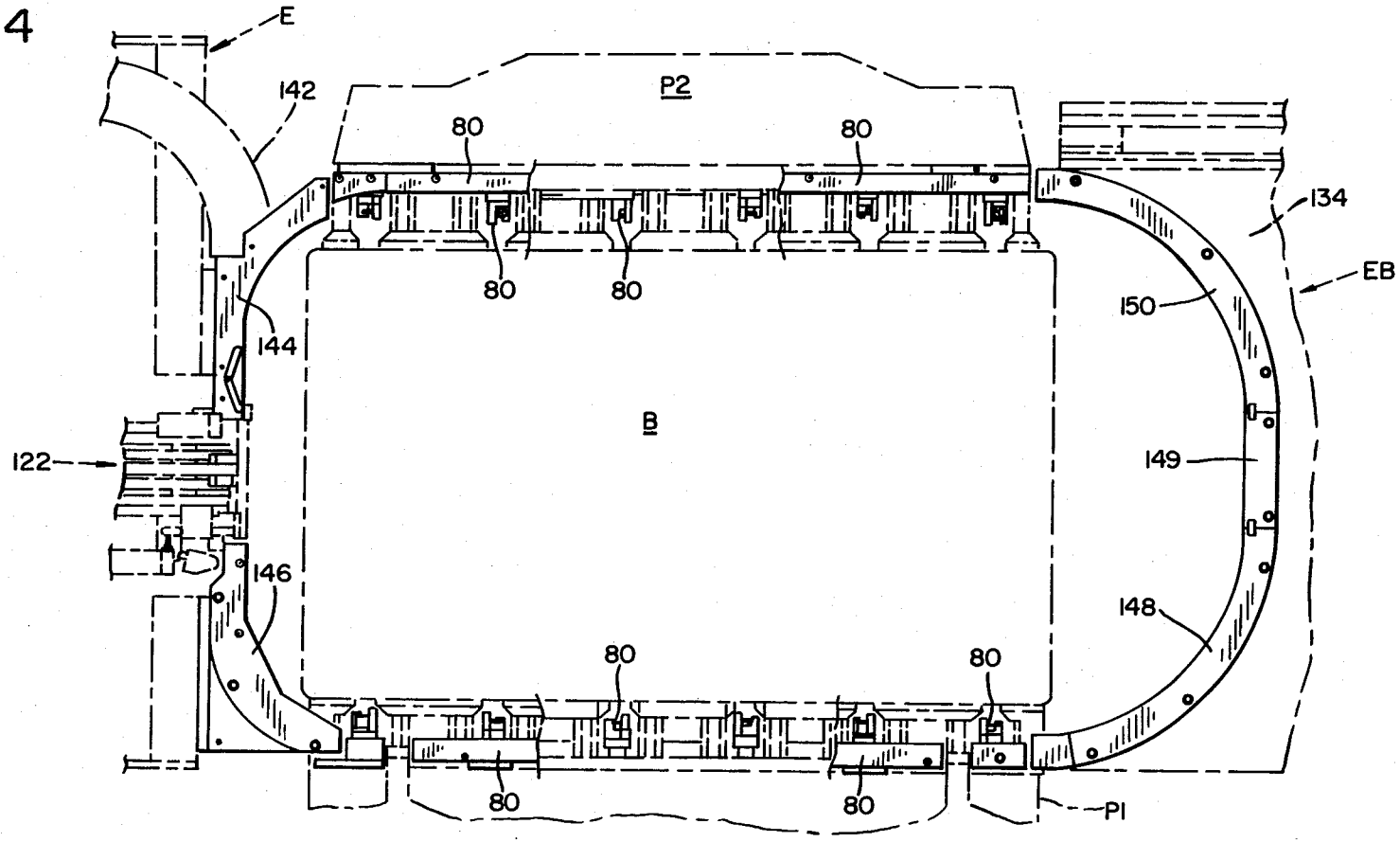
FIG. 4 is a sectional view on the line 4—4 in FIG. 2.

The guide track arrangement for the wire WL from end binder E is shown in FIG. 4. The curved vertical wire track 142 brings the wire from the wire feeding and tensioning mechanism to the knotter mechanism 122, in strapping section 110, from an individual source which is the same as take-up stand assembly T in FIG. 3. This wire travels through a portion of curved infeed guide track 144, through knotter mechanism 122, through a lower curved guide track 146 around the adjacent lower end of the bale, through a straight guide track 80 in the lower platen P1 of the press, then up through a curved guide track 148, straight guide track 149 and curved guide track 150 in the back track assembly EB, through a straight guide track 80 in upper platen P2 and back through curved guide track 144 to knotter mechanism 122.

The straight guide tracks 80 in the lower and upper platens are as shown in FIGS. 6, 7, and 8. In the lower guide track 80 in FIG. 4, the tapered end 96 of cover plate 90 is on the left end of this guide track, and in the guide track 80 in the upper platen the tapered end 96 is on the right end of the cover plate. Thus the tensioning of wire WL by the tensioning mechanism in strapping section 110 pulls the wire outward from each of these guide tracks in succession to tighten it around the top, remote end and bottom of the bale.

As previously stated, the sequence of operations is started by a signal from the press that the press chamber is ready for binding of the bale. First, end binder E and end back track assembly EB move from their retracted rest positions in toward opposite ends of the bale B. In the case of end binder E two separate movements are required. The rest position of strapping section 110 shown in solid lines in FIG. 2 allows it to move forward on carriage 108 by the action of hydraulic cylinder 120 and pass between the posts 10. When strapping section 110 has cleared the posts 10, carriage 108 is moved laterally by hydraulic cylinder 118 to place the knotter 122 on the longitudinal center line of the bale as shown in broken lines to place the wire WL midway between the opposite sides of the bale.

At the same time, the two side binders SB1 and SB2 move from their rest positions in solid lines and latch in their first strapping stations shown in broken lines. The carriage sections latch in position at this first strapping station and their strapping sections move inward to wire feed positions on opposite sides of the bale.

End binder E feeds wire WL around the platen tracks and the end back tracks in end back track assembly EB and back into the end binder E, stops and grips the leading end of the wire, then immediately tensions the wire around the bale and holds it.

Side binder SB1 then feeds wire W2 around the wire tracks in this wire position and side binder SB2 simultaneously feeds wire W1 in the opposite direction around the wire tracks in this wire position, then both side binders stop and grip the leading ends of the wires thus fed around the bale.

The side binder wire feeding movements then immediately reverse into tension cycle drawing the wires tightly about the bale and the knotter in each side binder ties the knot in the wire which it has fed around the bale, allowing the bale growth into the wire length desired.

The two side binder strapping sections then retract away from the bale, the carriage sections release from their latched positions in their first binding station and move back to their second binding stations for the application of wires W3 and W4, stop in position, latch and repeat the steps described above at the first strapping station.

Then the two side binders move back to a third strapping station and repeat the described steps again for the application of wires 5 and 6. Following this operation the strapping sections of the two side binders retract again and the side binders return to their rest positions in solid lines in FIG. 2.

As the two side binders return to their rest positions, end binder E ties the knot in wire WL, releases the wire, carriage 108 reverses its previous side travel and strapping section 110 retracts between columns 10 to its rest position in solid lines. During these movements, end back track assembly EB has retracted back to its rest position.

Upon return of both side binders SB1 and SB2, end binder E and end back track assembly EB to their rest positions the press is signaled to open and discharge the bale. The binders then await a signal from the press that the next bale is ready to be bound.

If desired, the binders may be programmed to apply two wires in each wire position instead of a single wire.

The sequence of events described is controlled by appropriate switches automatically actuated by the completion of each operation to start the next operation. In the event that one wire fails to tie properly or doesn't complete its cycle it may be stopped by manually depressing the appropriate manual override button on the operator's panel. The operator may run the carriages or strapping sections to new locations or positions by depressing the appropriate combination of buttons provided for these purposes. Such override is provided to minimize the possibilities of running out of wire from the supply coils or feeding too much wire around the tracks or unthreading the feed units in the event the gripper fails to operate. The control circuits for these operations are understood by persons skilled in the art and are not included in the present description.

Figure 14:
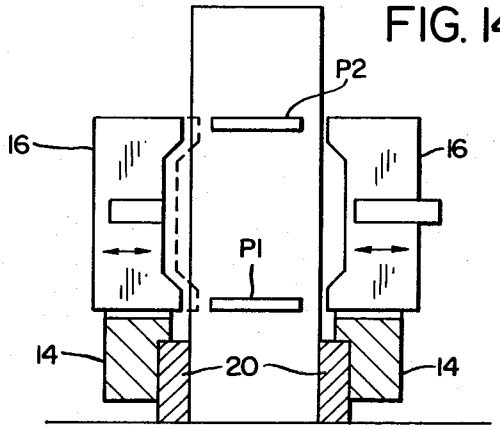
FIG. 14 is a schematic sectional view through the press showing the relationship between the carriage section and strapping section in each of a pair of side binders on front and back sides of the bale in the embodiment illustrated in FIGS. 1 and 2 wherein the carriage section is below the strapping section.

FIG. 14 is a schematic view of the side binder arrangement just described wherein the strapping sections 16 move in and out toward and away from the opposite sides of the bale on top of carriage sections 14 which travel lengthwise of the bale on carriage tracks 20.

Figure 15:
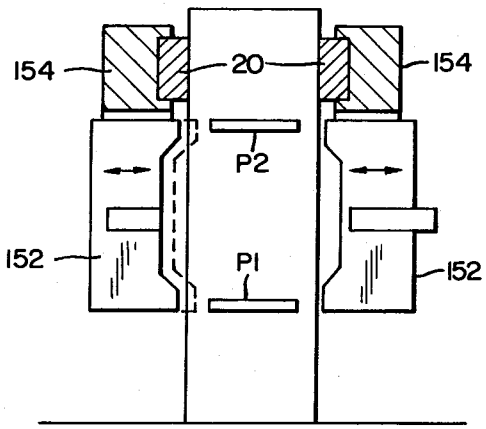
FIG. 15 is a similar view showing a modification wherein the carriage section of each side binder is above the strapping section.

FIG. 15 is a similar schematic view of a modification in which the strapping sections 152 of the side binders are mounted under the carriage sections 154.

Another possible modification is to provide one side binder with two sets of mechanisms for feeding, tensioning and knotting both wires at each binding station and providing the opposite side binder with two sets of back tracks for those two wires, whereby all the knots would be on the same side of the bale. Thus, in FIG. 2 at the first binding station where SB1 and SB2 appear in broken lines, SB1 would have a wire feed, wire tensioning and knotter mechanism for each of wires W1 and W4 and SB2 would have merely two sets of back tracks for these two wires.

Figure 16:
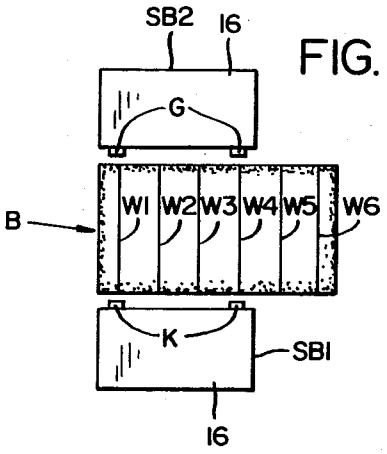
FIG. 16 is a schematic top plan view of a further modification.

This arrangement is illustrated in FIG. 16 where side binder SB1 has two knotters K and side binder SB2 has two back track wire guides G. Each side binder has a carriage section and a strapping section and these sections may be arranged as shown in FIG. 14 or as shown in FIG. 15.

Still other alternatives are contemplated. There may be more than one binder on one or both sides of the bale. If a longitudinal strap loop WL is not desired, the end binder E and end back track assembly EB are omitted. In any case the construction may be modified to adapt to a particular form of press.

What is claimed is:

1. Apparatus for strapping bales of material comprising a pair of structurally separate side binders movable along opposite sides of the bale to a series of strapping stations, each of said side binders comprising a carriage section running on a carriage track alongside the bale and a strapping section movable on said carriage section by power means in a direction toward and away from the adjacent side of the bale.

2. Apparatus as defined in claim 1, said strapping section being on top of said carriage section.

3. Apparatus as defined in claim 1, said strapping section being under said carriage section.

4. Apparatus as defined in claim 1 including means in the strapping section of one of said side binders for applying a strap around the bale from one side of the bale in one strap position on the bale at each of said stations, and means in the strapping section of the other side binder for applying a strap around the bale from the opposite side of the bale in another strap position on the bale at each of said stations.

5. Apparatus as defined in claim 4 including strap guide means in the strapping section of said one side binder for the strap applied by said other side binder and strap guide means in the strapping section of said other side binder for the strap applied by said one side binder.

6. Apparatus as defined in claim 1 including means in the strapping section of one of said side binders for applying straps around the bale from one side of the bale in two strap positions on the bale at each of said stations, and strap guide means in the strapping section of the other side binder for both straps applied by said one side binder at each station.

7. Apparatus as defined in claim 1 including a pair of horizontal track rails on said carriage section at right angles to said carriage track supporting said strapping section on said carriage section, and power operated means for moving said strapping section on said track rails toward and away from the adjacent side of the bale.

8. Apparatus as defined in claim 1 including an end binder movable toward and away from one end of the bale and an end back track assembly movable toward and away from an opposite end of the bale for applying a strap around the top, bottom and ends of the bale.

9. Apparatus for strapping bales of material comprising a pair of side binders movable along opposite sides of the bale to a series of strapping stations, each of said side binders comprising a carriage section running on a carriage track alongside the bale and a strapping section movable on said carriage section in a direction toward and away from the adjacent side of the bale, an end binder movable toward and away from one end of the bale and an end back track assembly movable toward and away from an opposite end of the bale for applying a strap around the top, bottom and ends of the bale.

10. In an apparatus for strapping bales of material, lower and upper press platens containing strap guides for a strap loop around the top, bottom and sides of the bale and containing strap guides for a strap loop around the top, bottom and ends of the bale, each of said strap guides having a pair of opposite side walls, a back wall and an open front side facing the bale to form a slot for said strap, a cover strip parallel with said back wall normally confining said strap in a space between said cover strip and said back wall, and aligned slots in said side walls receiving opposite side edge portions of said cover strip to close said strap slot over the strap, said cover strip being retractable into one of said side wall slots for opening said strap slot to release the strap as the strap is stripped from the strap slot, spring means acting on the side edge of said cover strip in said one side wall slot to press the opposite side edge portion of said cover strip into the opposite side wall slot, said spring means comprising a pin slidable in a hole in said strap guide with one end of said pin bearing against the side edge of said cover strip in said one side wall slot, and a leaf spring on said strap guide bearing against the opposite end of said pin, one end of said cover strip being tapered in width to initiate retraction of said cover strip into said one side wall slot when said strap is tensioned in a direction outward from said strap slot to strip the strap from the strap slot.

11. In an apparatus for strapping bales of material, lower and upper press platens containing strap guides for a strap loop around the top, bottom and ends of the bale and containing strap guides for a plurality of strap loops around the top, bottom and sides of the bale, a pair of side binders movable along opposite sides of the bale for applying said strap loops around the top, bottom and sides of the bale, and means for applying said strap loop around the top, bottom and ends of the bale comprising an end binder movable toward and away from one end of the bale and an end back track assembly movable toward and away from the opposite end of the bale.

* * * * *